United States Patent [19]

Fuhre

[11] 4,289,152

[45] Sep. 15, 1981

[54] NAIL CLEANER

[76] Inventor: Leo M. Fuhre, 6905 Arcola St., Burnaby, British Columbia, Canada, V5E 1H5

[21] Appl. No.: 42,381

[22] Filed: May 24, 1979

[51] Int. Cl.[3] ..... A45D 29/17; A61H 35/00

[52] U.S. Cl. ..... 132/74.5; 132/75; 128/370; 134/182

[58] Field of Search ..... 132/73, 73.5, 74.5, 132/75; 128/65, 365, 370, 375, 66; 239/502, 518, 590, 552; 134/109, 110, 111, 199, 200, 172, 173, 174, 182, 16; 4/165

[56] References Cited

U.S. PATENT DOCUMENTS

| | | | |
|---|---|---|---|
| 1,819,004 | 8/1931 | Roessinger | 132/73 |
| 2,212,567 | 8/1940 | Kirmes | 132/74.5 |
| 2,710,613 | 6/1955 | Fleming | 132/73 |
| 3,732,877 | 5/1973 | Kloeg | 134/111 |
| 4,020,856 | 5/1977 | Masterson | 132/74.5 |
| 4,137,929 | 2/1979 | Grossman | 134/182 |

OTHER PUBLICATIONS

Chemical Engineering, 8/16/65, p. 94, "Spray Nozzle".

*Primary Examiner*—Charles N. Hart
*Assistant Examiner*—David R. Sadowski
*Attorney, Agent, or Firm*—Townsend and Townsend

[57] ABSTRACT

A fingernail cleaning apparatus has a housing with an aperture for inserting a finger. A pump mounted on the housing has an intake port connecting the pump to the housing and a discharge port. A nozzle member is connected to the discharge port, has a discharge orifice located inwardly from the housing aperture and has a projection near the orifice for separating the fingertip from the fingernail when the fingertip is pushed against the nozzle member.

6 Claims, 3 Drawing Figures

NAIL CLEANER

BACKGROUND OF THE INVENTION

This invention relates to a fingernail cleaning apparatus.

Earlier patents reveal a number of devices for cleaning nails. For example, U.S. Pat. No. 4,020,856 to Masterson shows a device including an enclosure with an opening for inserting the hand, a reservoir for fluid, a pump and a plurality of nozzles for directing jets of liquid in the area of the nails. There is no way of positively pushing back the skin at the fingertips away from the nail.

U.S. Pat. No. 3,699,984to Davis shows a device for spray cleaning the hands and forearms.

U.S. Pat. No. 3,066,336 to Stobbe shows a device for cleaning the hands and arms with brushes.

U.S. Pat. No. 2,424,509 to Singer shows a scrubbing machine with a plurality of rotating members for cleaning the fingers.

SUMMARY OF THE INVENTION

According to the invention, a fingernail cleaning apparatus comprises a housing with a bottom and an aperture above the bottom for inserting a finger. A pump is mounted on the housing. The pump has an intake port connecting the pump to the housing near the bottom thereof for the intake of liquid from the housing and a discharge port for the discharge of liquid from the pump. A nozzle member is connected to the discharge port. The nozzle member has a discharge orifice located inwardly from the housing aperture and a projection near the orifice for pushing the skin near the fingertip away from the fingernail when the fingertip is pressed against the nozzle member.

The present invention provides distinct advantages when compared with the prior art. The projection on the nozzle member provides an edge for pushing back the skin at the tip of the finger so the pressurized liquid from the pump can be directed against the inside surface of the nail instead of being deflected by the skin. The improved nozzle member of the present invention provides a fingernail cleaning apparatus which is considerably more effective when compared with prior art devices.

In drawings which illustrate embodiments of the invention:

DESCRIPTION OF THE PREFERRED EMBODIMENTS

Figure 1:
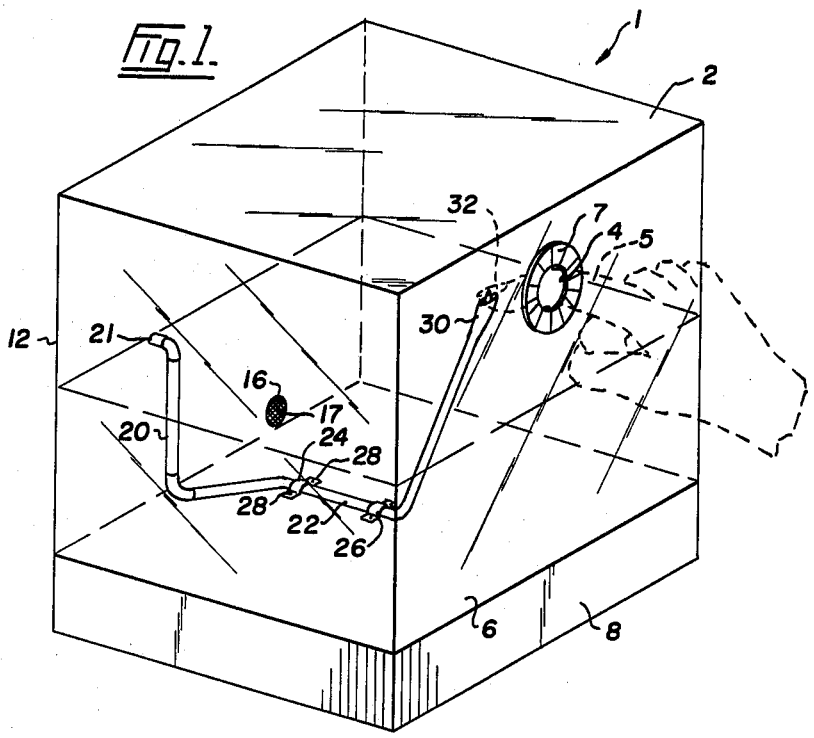
FIG. 1 is an isometric view of a fingernail cleaning apparatus according to an embodiment of the invention.

The fingernail cleaning apparatus 1 shown in the drawings has a hollow housing 2. The housing shown is cubical, but other shapes would also be suitable. The housing is transparent so that the fingernail cleaning operation can be viewed from the outside. The housing 2 can be made of any suitable plastic. The housing has a circular aperture 4 on the front thereof for inserting a finger 5 into the housing. An annular, elastic membrane 7 prevents the leakage of liquid from housing 2 when the finger is inserted. Except for aperture 4, the interior of housing 2 is watertight.

A pump 10 is mounted on the back 12 of the housing 2. The pump 10 comprises a single unit with the small electric motor 14. An AC motor powered by household current, or a DC motor, powered by batteries within compartment 8 below the bottom 6 of the housing 2, may be used. The pump 10 includes an intake port 16 which communicates with the inside of the housing 2 near the bottom 6 thereof. A filter 17 is provided at intake port 16. The pump also has a discharge port 18 for discharging liquid from the pump. A flexible hose 20 is connected to the discharge port 18 and projects through the aperture 21 in the housing 2. The other end of the hose 21 is connected to an elongate tubing 22 which curves downwardly and along the bottom 6 of the housing. A pair of metal tabs 24 and 26 and a plurality of screws 28 secure the tubing 22.

The tubing 22 extends between the back 12 of the housing and towards the aperture 4. The end of the tubing closest to aperture 4 curves upwardly away from the bottom 6 of the housing, is angled towards aperture 4, and forms a tubular nozzle member 30. The nozzle member 30 is located inwardly from the aperture 4 so that the fingertip of the finger 5 can rest on the upper end 34 of the nozzle member. The nozzle member 30 is elongate in the lateral dimension perpendicular to finger 5 and has a projection 40 which extends outwardly from the center of orifice 38. Projection 40 is laterally flat with a pointed tip 39.

Figure 2:
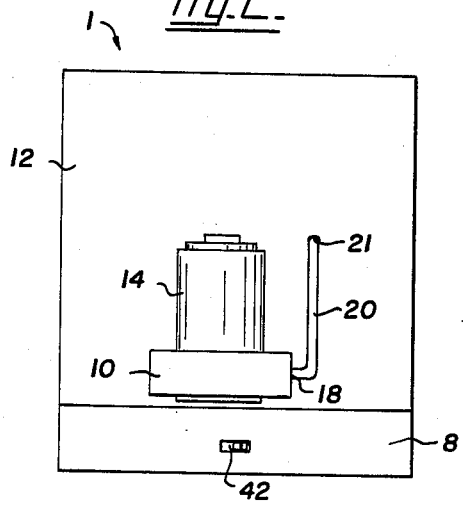
FIG. 2 is a rear elevational view of the apparatus.
Figure 3:
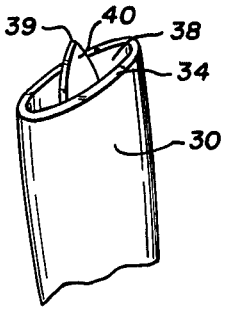
FIG. 3 is an enlarged fragmentary view of the nozzle member of the apparatus shown in FIGS. 1 and 2.

In use, a quantity of warm soapy water, or another suitable cleaning liquid, is put in housing 2 through the aperture 4. When the apparatus is properly oriented as shown in FIGS. 1 and 2, the water forms a pool in the bottom of the housing. A switch 42 is used to turn on the motor 14 to operate the pump 10. The water is drawn from the housing 2 through the intake port 16 and is discharged from the pump through the discharge port 18 and flows through the hose 20 and tubing 22 to the nozzle member 30.

To clean a fingernail, each finger is placed in turn through the aperture 4 as shown for finger 5 in FIG. 1. The fingertip rests upon the upper end 34 of the nozzle member and a slight downward pressure is applied so projection 40 pushes the skin at the fingertip away from the fingernail. The water sprays upwardly from orifice 38 around projection 40 and is directed against the back surface of the nail. As the water is discharged from nozzle member 30, it spills back into the bottom of the housing and is recirculated into the pump 10 through the intake port 16.

What I claim is:

1. A fingernail cleaning apparatus comprising:

a housing with a bottom and an aperture above the bottom for inserting a finger;

a pump mounted on the housing having an intake port connecting the pump to the housing near the bottom thereof for the intake of liquid from the housing and a discharge port for the discharge of liquid from the pump;

a nozzle member connected to the discharge port having a discharge orifice located inwardly from the housing aperture; and a pointed projection disposed within the orifice oriented generally parallel to the flow of liquid through the orifice for pushing the skin near the fingertip away from the fingernail when the fingertip is pressed against the nozzle member to provide access for liquid issuing from the orifice to a space behind the fingernail without affecting the directionality of liquid issuing from the orifice so as to affect a complete cleaning of the space.

2. An apparatus as claimed in claim 1, the projection extending outwardly from near the center of the orifice.

3. An apparatus as claimed in claim 2, the projection being flat and pointed.

4. An apparatus as claimed in claim 3, the nozzle member being tubular with an end for receiving the fingertip and being elongate in a lateral dimension perpendicular to the finger.

5. An apparatus as claimed in claim 4, the nozzle member extending upwardly from near the bottom of the housing and being angled towards the aperture in the housing.

6. An apparatus as claimed in claim 5, the pump being exterior to the housing, the intake port and the discharge port communicating with the interior of the housing.

* * * * *